US012371819B2

(12) United States Patent
Ogino

(10) Patent No.: US 12,371,819 B2
(45) Date of Patent: Jul. 29, 2025

(54) CORE-SHEATH CONJUGATE FIBER FOR ARTIFICIAL HAIR, HAIR ORNAMENT INCLUDING SAME, AND METHOD FOR PRODUCING SAME

(71) Applicant: KANEKA CORPORATION, Osaka (JP)

(72) Inventor: Takashi Ogino, Osaka (JP)

(73) Assignee: KANEKA CORPORATION, Osaka (JP)

( * ) Notice: Subject to any disclaimer, the term of this patent is extended or adjusted under 35 U.S.C. 154(b) by 273 days.

(21) Appl. No.: 18/254,250

(22) PCT Filed: Oct. 15, 2021

(86) PCT No.: PCT/JP2021/038263
§ 371 (c)(1),
(2) Date: May 24, 2023

(87) PCT Pub. No.: WO2022/145110
PCT Pub. Date: Jul. 7, 2022

(65) Prior Publication Data

US 2024/0108091 A1 Apr. 4, 2024

(30) Foreign Application Priority Data

Dec. 28, 2020 (JP) ..... 2020-219463

(51) Int. Cl.
*D01F 8/14* (2006.01)
*D01F 8/12* (2006.01)

(52) U.S. Cl.
CPC ..... *D01F 8/14* (2013.01); *D01F 8/12* (2013.01); *D10B 2503/08* (2013.01)

(58) Field of Classification Search
CPC ..... A41G 3/0083; A41G 3/00; D01F 8/14; D01F 8/12; D01F 8/04; D01D 5/253; D01D 5/34; D10B 2503/08
(Continued)

(56) References Cited

U.S. PATENT DOCUMENTS

2009/0126749 A1 5/2009 Shirakashi et al.
2019/0090565 A1 3/2019 Miyata et al.
2021/0363667 A1 11/2021 Sakamoto et al.

FOREIGN PATENT DOCUMENTS

EP 1 852 022 A1 11/2007
JP 2020-133021 A 8/2020
(Continued)

OTHER PUBLICATIONS

International Search Report issued in PCT/JP2021/038263; mailed Dec. 7, 2021.

*Primary Examiner* — Camie S Thompson
(74) *Attorney, Agent, or Firm* — Studebaker Brackett PLLC

(57) ABSTRACT

One or more embodiments of the present disclosure relate to a core-sheath conjugate fiber for artificial hair including a core and a sheath. The core is composed of a polyester-based resin composition containing a polyester-based resin as a main component, and the sheath is composed of a polyamide-based resin composition containing a polyamide-based resin as a main component. The sheath contains at least one organic pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that contains no metal and contains a nitro group. The core contains a pigment that is different from that of the sheath.
(Continued)

As a result, core-sheath conjugate fibers for artificial hair having a texture that is similar to that of human hair and having favorable coloring properties and spinnability, hair ornaments including the core-sheath conjugate fibers for artificial hair, and a method for producing the core-sheath conjugate fibers for artificial hair are provided.

16 Claims, 2 Drawing Sheets

(58) Field of Classification Search
USPC ..... 428/373
See application file for complete search history.

(56) References Cited

FOREIGN PATENT DOCUMENTS

| | | | |
|---|---|---|---|
| WO | 2006/087911 | A1 | 8/2006 |
| WO | 2017/187843 | A1 | 11/2017 |
| WO | 2020/166263 | A1 | 8/2020 |

CORE-SHEATH CONJUGATE FIBER FOR ARTIFICIAL HAIR, HAIR ORNAMENT INCLUDING SAME, AND METHOD FOR PRODUCING SAME

TECHNICAL FIELD

The present invention relates to core-sheath conjugate fibers for artificial hair that can be used as an alternative to human hair, hair ornaments including the core-sheath conjugate fibers for artificial hair, and a method for producing the core-sheath conjugate fibers for artificial hair.

BACKGROUND ART

Human hair has conventionally been used for hair ornaments such as hairpieces, hair wigs, hair extensions, hair bands, and doll hair. However, in recent years, it has become difficult to obtain human hair. For this reason, there is a growing demand for artificial hair that can replace human hair.

Examples of synthetic fibers used as a material of artificial hair include acrylic fibers, vinyl chloride fibers, vinylidene chloride fibers, polyester fibers, polyamide fibers, and polyolefin fibers. Patent Document 1 proposes, as a fiber for artificial hair, a core-sheath conjugate fiber in which polyester is a core component and polyamide is a sheath component, for example.

CITATION LIST

Patent Document

[Patent Document 1] WO 2017/187843A1

DISCLOSURE OF INVENTION

Problem to be Solved by the Invention

However, fibers containing a polyamide as a sheath component as described in Patent Document 1 have a texture similar to that of human hair, but if a spin-dyeing process is to be performed using a pigment, the core component and the sheath component have different refractive indices. Therefore, there has been a problem that refraction occurs at the interface between these components, making it difficult to obtain desired hue.

In order to solve the problems, one or more embodiments of the present invention provide core-sheath conjugate fibers for artificial hair that have a texture similar to that of human hair, and favorable coloring properties and spinnability, a hair ornament including the same, and a method for producing the same.

Means for Solving Problem

One or more embodiments of the present invention relate to a core-sheath conjugate fiber for artificial hair that includes a core and a sheath. The core is composed of a polyester-based resin composition containing a polyester-based resin, and the sheath is composed of a polyamide-based resin composition containing a polyamide-based resin. The sheath contains at least one organic pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that contains no metal and contains a nitro group, and the core contains a pigment that is different from the organic pigment of the sheath.

One or more embodiments of the present invention also relate to a hair ornament including the core-sheath conjugate fiber for artificial hair.

One or more embodiments of the present invention relate to a method for producing the core-sheath conjugate fiber for artificial hair, the method inducting producing a pigment masterbatch for a sheath by mixing, into a polyamide-based resin, at least one sheath pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that contains no metal and contains a nitro group; producing a pigment masterbatch for a core by mixing a pigment that is different from the sheath pigment into a polyester-based resin; and melt spinning a core resin composition and a sheath resin composition using a core-sheath conjugate nozzle.

Effects of the Invention

One or more embodiments of the present invention can provide core-sheath conjugate fibers for artificial hair that have a texture similar to that of human hair, and favorable coloring properties and spinnability, and a hair ornament.

According to a production method of one or more embodiments of the present invention, it is possible to obtain core-sheath conjugate fibers for artificial hair that have a texture similar to that of human hair, and favorable coloring properties, at high spinnability.

DESCRIPTION OF THE INVENTION

Figure 1:
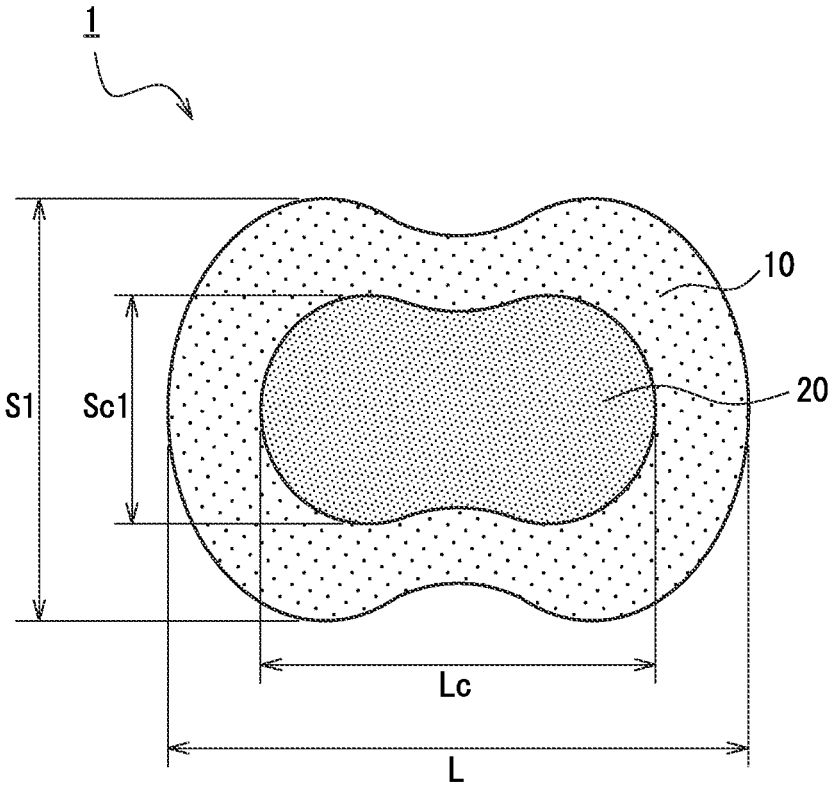
FIG. 1 is a schematic view showing a fiber cross-section of a core-sheath conjugate fiber for artificial hair according to one or more embodiments of the present invention.

The inventor of the present invention conducted studies in order to solve the above-described conventional technical problems. As a result, the inventor of the present invention found that core-sheath conjugate fibers for artificial hair that has a texture similar to that of human hair, and has favorable coloring properties and spinnability could be obtained as a result of in a core-sheath conjugate fiber for artificial hair in which a core is composed of a polyester-based resin composition containing a polyester-based resin as a main component and a sheath is composed of a polyamide-based resin composition containing a polyamide-based resin as a main component, adding, to the sheath, at least one pigment selected from the group consisting of (a) a nickel complex pigment (also simply referred to as "nickel complex pigment (a)" in the following) in which nickel and an organic dye structure are in a coordinate bond at a ratio of 1:1 or 1:2, (b) a chromium complex pigment (also simply referred to as "chromium complex pigment (b)" in the following) in which chromium and an organic dye structure are in a coordinate bond at a ratio of 1:1 or 1:2, and (c) an organic pigment (also simply referred to as "nitro group-containing organic pigment (c)" in the following) that contains no metal and contains a nitro group, and adding, to the core, a pigment different from that of the sheath.

Sheath Pigment

The sheath contains at least one organic pigment selected from the group consisting of nickel complex pigments (a), chromium complex pigments (b), and nitro group-containing organic pigments (c).

<Nickel Complex Pigment (a)>

A nickel complex pigment (a) is a metal complex pigment in which nickel and an organic dye structure are in a coordinate bond at a ratio of 1:1 or 1:2.

In the nickel complex pigment (a), examples of the organic dye structure include an azo-based structure, an azomethine-based structure, and a phthalocyanine-based structure. In particular, from the viewpoint of being easily dispersed in a polyamide-based resin, the organic dye structure is preferably at least one selected from the group consisting of an azo-based structure and an azomethine-based structure.

The nickel complex pigment (a) may contain at least one functional group selected from the group consisting of a sulfone group, a sulfonamide group, and a nitro group.

Specifically, azomethine-based nickel complex pigments represented by the following chemical formula (1) and the like can be used as the nickel complex pigment (a).

[Chemical formula 1]

(1)

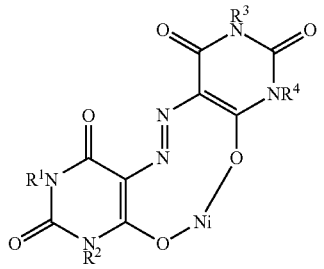

In the chemical formula (1), $R^1$ to $R^4$ each independently represent a hydrogen atom, a hydrocarbon group having 1 to 5 carbon atoms, or a sulfone group. Examples of the hydrocarbon group having 1 to 5 carbon atoms include a methyl group and an ethyl group.

Pigment Yellow 150 (CAS Number: 68511-62-6) or the like can be suitably used as the azomethine-based nickel complex pigment represented by the chemical formula (1), for example.

Pigment Yellow 150 is a 5,5'-azodi(2,4,6-pyrimidinetriol) 1:1 type nickel (II) complex salt, and has the structure represented by the following chemical formula (2).

[Chemical formula 2]

(2)

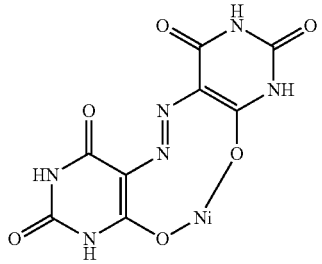

<Chromium Complex Pigment (b)>

A chromium complex pigment (b) is a metal complex pigment in which chromium and an organic dye structure are in a coordinate bond at a ratio of 1:1 or 1:2.

In the chromium complex pigment (b), examples of the organic dye structure include an azo-based structure, an azomethine-based structure, and a phthalocyanine-based structure. In particular, from the viewpoint of being easily dispersed in a polyamide-based resin, the organic dye structure is preferably at least one selected from the group consisting of an azo-based structure and an azomethine-based structure.

The chromium complex pigment (b) may contain at least one functional group selected from the group consisting of a sulfone group, a sulfonamide group, and a nitro group.

Azo-based chromium complex pigments represented by the following chemical formulae (3) and (4) and the like can be suitably used as the chromium complex pigment (b).

[Chemical formula 3]

(3)

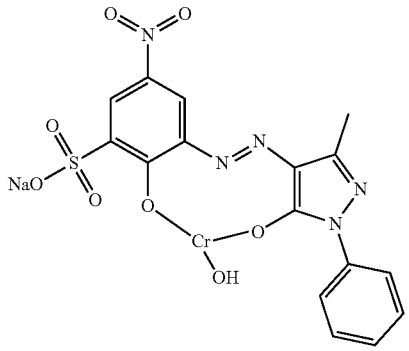

-continued

[Chemical formula 4] (4)

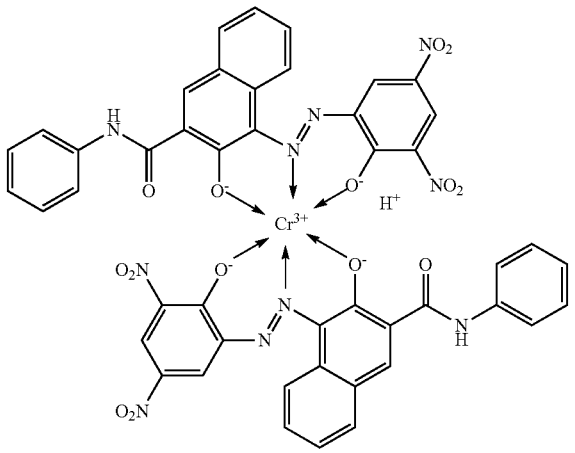

The azo-based chromium complex pigment (CAS Number: 10127-27-2) represented by the chemical formula (3) is 3-[[(4,5-dihydro-3-methyl-5-oxo-1-phenyl-1H-pyrazol)-4-yl]azo]-2-hydroxy-5-nitrobenzenesulfonic acid/sodium/chromic acid (1:1:1), and contains a nitro group and a sulfone group, and is also referred to as acid orange 74.

The azo-based chromium complex pigment (CAS Number: 84179-66-8) represented by the chemical formula (4) is bis[3-hydroxy-4-[(2-hydroxy-3,5-dinitrophenyl)azo]-N-phenyl-2-naphthalenecarboxamide (2-)]hydrogen chromate, and contains a nitro group.

<Nitro Group-Containing Organic Pigment (c)>

An organic pigment that contains no metal and contains a nitro group can be used as the nitro group-containing organic pigment (c) as appropriate. Examples of the nitro group-containing organic pigment (c) include nitro group-containing azo-based organic pigments, nitro group-containing azomethine-based organic pigments, nitro group-containing azobenzene-based organic pigments, and nitro group-containing hydrazine-based organic pigments. In particular, from the viewpoint of being easily dispersed in a polyamide-based resin, the nitro group-containing organic pigment (c) is preferably at least one selected from the group consisting of a nitro group-containing azo-based organic pigment, a nitro group-containing azomethine-based organic pigment, and a nitro group-containing azobenzene-based organic pigment.

A nitro group-containing azo-based organic pigment represented by the following chemical formula (5) or the like can be used as the nitro group-containing organic pigment (c).

[Chemical formula 5] (5)

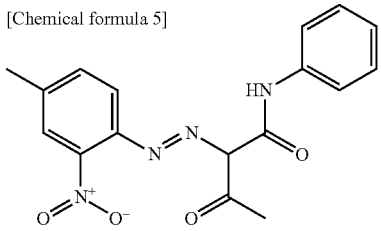

The nitro group-containing azo-based organic pigment (CAS Number: 2512-29-0) represented by the chemical formula (5) is N-phenyl-2-(4-methyl-2-nitrophenylazo)-3-oxobutanamide, and is also referred to as Hansa Yellow.

Sheath pigments may be used individually or in combinations of two or more.

Core Pigment

A pigment that is different from the above-described sheath pigment can be used for the core as appropriate. There is no particular limitation on the core pigment, and inorganic pigments or organic pigments can be used, for example. Examples of inorganic pigments include carbon black and titanium oxides. Examples of organic pigments include anthraquinone-based pigments and perylene-based pigments.

Specifically, the anthraquinone-based pigment represented by the following chemical formula (6), the perylene-based pigment represented by the following chemical formula (7), or the like may be used as a core pigment.

[Chemical formula 6] (6)

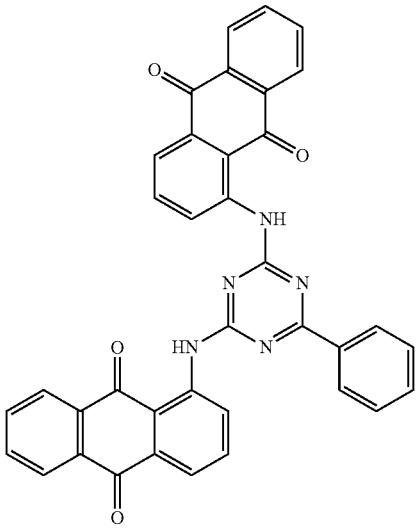

-continued

[Chemical formula 7]

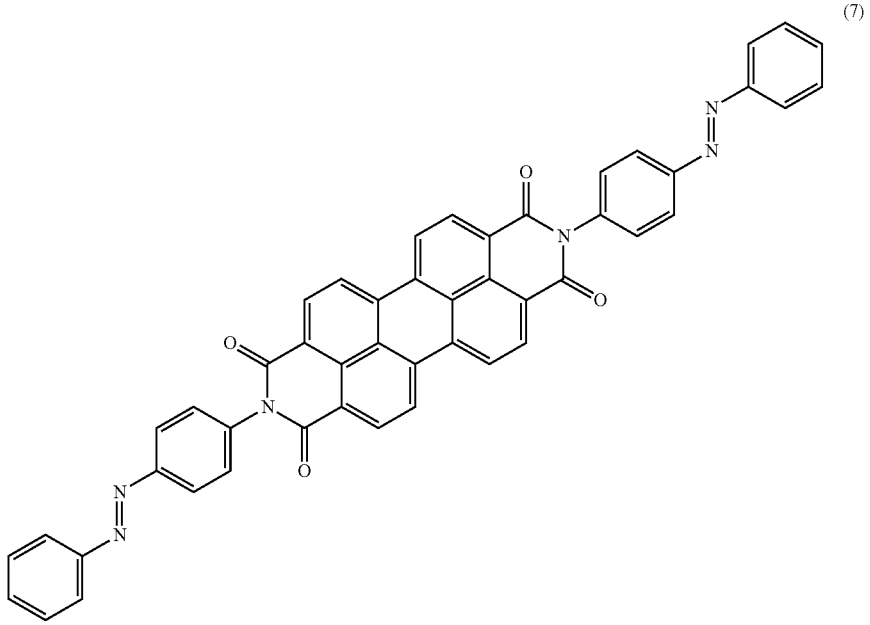

The anthraquinone-based pigment (CAS Number: 4118-16-5) represented by the chemical formula (6) is 1,1'-[(6-phenyl-1,3,5-triazine-2,4-diyl)bis(imino)]bis(9,10-anthracenedione), and is referred to as Pigment Yellow 147.

The perylene-based pigment (CAS Number: 3049-71-6) represented by the chemical formula (7) is Pigment Red 178.

Core pigments may be used individually or in combinations of two or more.

Fiber Shape

In one or more embodiments of the present invention, the cross-sectional shape of the core-sheath conjugate fiber for artificial hair is not particularly limited, and may be circular or non-circular. Examples of a non-circular cross-sectional shape thereof include an elliptical shape and flat multilobed shapes such as a flat bilobed shape.

In one or more embodiments of the present invention, the flat multilobed shape is a shape in which two or more lobed portions having a shape selected from the group consisting of a circular shape and an elliptical shape are connected via recesses. In one or more embodiments of the present invention, the flat bilobed shape is a shape in which two lobed portions having a shape selected from the group consisting of a circular shape and an elliptical shape are connected via recesses. In a flat multilobed shape and a flat bilobed shape, a circular and/or elliptical shape partially overlap each other at the connected portion. The shape of the circular or elliptical portions does not absolutely have to be a continuous arc, and may also be a substantially circular shape or substantially elliptical shape that is partially deformed, as long as no acute angle is formed.

In one or more embodiments of the present invention, the cross-sectional shape of the core is not particularly limited, and may be circular or non-circular. Examples of a non-circular cross-sectional shape thereof include an elliptical shape and flat multilobed shapes such as a flat bilobed shape.

Note that, as for the cross-sectional shape, no consideration needs to be given to an unevenness with a size of 2 μm or less derived from an additive or the like and generated at an outer circumference of the fiber and/or the core.

In one or more embodiments of the present invention, from the viewpoint of further improving a texture, the cross-sectional shape of the core-sheath conjugate fiber for artificial hair is preferably an elliptical shape and/or a flat multilobed shape, and more preferably a flat multilobed shape, and even more preferably a flat bilobed shape.

In one or more embodiments of the present invention, the cross-sectional shape of the core-sheath conjugate fiber for artificial hair and the cross-sectional shape of the core may be the same or different from each other.

In the core-sheath conjugate fiber for artificial hair according to one or more embodiments of the present invention, the fiber cross-section and the core cross-section preferably have the same flat multilobed shape in which a major axis of the core cross-section is in a direction that substantially coincides with a direction of a major axis of the fiber cross-section. In one or more embodiments of the present invention, the wording "the major axis of the core cross-section is in a direction that substantially coincides with a direction of the major axis of the fiber cross-section" indicates that an angle formed between the major axis of the fiber cross-section and the major axis of the core cross-section is less than 15 degrees. In the case of the same flat multilobed shape in which the major axis of the core cross-section is in a direction that substantially coincides with a direction of the major axis of the fiber cross-section, because the outer circumferential shape of the fiber cross-section and the outer circumferential shape of the core cross-section are similar to each other on the fiber cross-section, the sheath has an even thickness, and thus a good texture and a favorable appearance of the fiber for artificial hair are maintained and it is also possible to prevent the core from being exposed from the fiber surface.

FIG. 1 is a schematic view showing a fiber cross-section of a core-sheath conjugate fiber for artificial hair according to an example of the present invention. The core-sheath conjugate fiber 1 for artificial hair includes a sheath 10 and a core 20, and the fiber 1 and the core 20 have a flat bilobed fiber cross-section in which two elliptical portions are connected via recesses.

It is preferable that, on a flat bilobed fiber cross-section of the core-sheath conjugate fiber for artificial hair, a length (referred to as L) of a major axis of the fiber cross-section, where the major axis of the fiber cross-section is a longest straight line among an axisymmetric axis and straight lines connecting any two points on the outer circumference of the fiber cross-section so as to be parallel to the axisymmetric axis, and a length (referred to as S1) of a first minor axis of the fiber cross-section, where the first minor axis of the fiber crass-section is a longest straight line formed when any two points on the outer circumference of the fiber crass-section are connected perpendicularly to the major axis of the fiber crass-section, satisfy the equation (1) below.

$$L/S1=1.1 \text{ or more and } 2.0 \text{ or less} \quad (1)$$

Further, it is preferable that, on a flat bilobed fiber cross-section, a length (referred to as Lc) of a major axis of the core cross-section, where the major axis of the core crass-section is a longest straight line among an axisymmetric axis and straight lines connecting any two points on the outer circumference of the core cross-section so as to be parallel to the axisymmetric axis, and a length (Sc1) of a first minor axis of the core cross-section, where the first minor axis of the core cross-section is a longest straight line formed when any two points on the outer circumference of the core cross-section are connected perpendicularly to the major axis of the core cross-section, satisfy the equation (2) below.

$$Lc/Sc1=1.3 \text{ or more and } 2.0 \text{ or less} \quad (2)$$

The above-described cross-sectional shapes of the fiber and the core can be controlled by using a nozzle (pores) with a shape dose to the target cross-sectional shape.

In one or more embodiments of the present invention, the core-to-sheath area ratio of the core to the sheath of the core-sheath conjugate fiber for artificial hair is, but is not particularly limited to, preferably 2:8 to 9:1, more preferably 3:7 to 8:2, and even more preferably 4:6 to 7:3. When the core-to-sheath area ratio is in the above range, a texture and a feel of the core-sheath conjugate fiber for artificial hair can be similar to those of human hair.

From the viewpoint of suitability for artificial hair, the core-sheath conjugate fiber for artificial hair according to one or more embodiments of the present invention preferably has a single fiber fineness of preferably 10 dtex or more and 150 dtex or less, more preferably 30 dtex or more and 120 dtex or less, even more preferably 40 dtex or more and 100 dtex or less, and even more preferably 50 dtex or more and 90 dtex or less.

When the core-sheath conjugate fibers for artificial hair according to one or more embodiments of the present invention are in the form of an aggregate of fibers, e.g., a fiber bundle, all the fibers do not necessarily have the same fineness, and the same cross-sectional shape, but some of them may have different finenesses, and cross-sectional shapes.

Fiber Composition

In one or more embodiments of the present invention, the sheath is composed of a polyamide-based resin composition (also referred to as "sheath resin composition" in the following) containing a polyamide-based resin as a main component, and thus has a good texture. In one or more embodiments of the present invention, "the polyamide-based resin composition containing a polyamide-based resin as a main component" indicates that the polyamide-based resin composition contains the polyamide-based resin in an amount of more than 55% by weight or more with respect to 100% by weight of the total weight of the polyamide-based resin composition, and the content of the polyamide-based resin is more preferably 60% by weight or more, even more preferably 67% by weight or more, further preferably 75% by weight or more, still more preferably 85% by weight or more, yet more preferably 90% by weight or more, and still more preferably 95% by weight or more.

The polyamide-based resin refers to a nylon resin obtained by polymerizing at least one selected from the group consisting of lactam, an aminocarboxylic acid, a mixture of a dicarboxylic acid and diamine, a mixture of a dicarboxylic acid derivative and diamine, and a salt of a dicarboxylic acid and diamine.

Specific examples of the lactam include, but are not particularly limited to, 2-azetidinone, 2-pyrrolidinone, δ-valerolactam, ε-caprolactam, enantholactam, caprylactam, undecalactam, and laurolactam. Among them, ε-caprolactam, undecalactam, and laurolactam are preferred, and ε-caprolactam is particularly preferred. These lactams may be used individually or in combinations of two or more.

Specific examples of the aminocarboxylic acid include, but are not particularly limited to, 6-aminocaproic acid, 7-aminoheptanoic acid, 8-aminooctanoic acid, 9-aminononanoic acid, 10-aminodecanoic acid, 11-aminoundecanoic acid, and 12-aminododecanoic acid. Among them, 6-aminocaproic acid, 11-aminoundecanoic acid, and 12-aminododecanoic acid are preferred, and 6-aminocaproic acid is particularly preferred. These aminocarboxylic acids may be used individually or in combinations of two or more.

Specific examples of the dicarboxylic acid, which is used in the mixture of a dicarboxylic acid and diamine, the mixture of a dicarboxylic acid derivative and diamine, or the salt of a dicarboxylic acid and diamine, include, but are not particularly limited to, the following: aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brassylic acid, tetradecanedioic acid, pentadecanedioic acid, and octadecanedioic acid; alicyclic dicarboxylic acids such as cyclohexanedicarboxylic acid; and aromatic dicarboxylic acids such as phthalic acid, isophthalic acid, terephthalic acid, and naphthalenedicarboxylic acid. Among them, adipic acid, sebacic acid, dodecanedioic acid, terephthalic acid, and isophthalic acid are preferred, and adipic acid, terephthalic acid, and isophthalic acid are particularly preferred. These dicarboxylic acids may be used individually or in combinations of two or more.

Specific examples of the diamine, which is used in the mixture of a dicarboxylic acid and diamine, the mixture of a dicarboxylic acid derivative and diamine, or the salt of a dicarboxylic acid and diamine, include, but are not particularly limited to, the following: aliphatic diamines such as 1,4-diaminobutane, 1,5-diaminopentane, 1,6-diaminohexane, 2-methyl-1,5-diaminopentane (MDP), 1,7-diaminoheptane, 1,8-diaminooctane, 1,9-diaminononane, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as m-xylylenediamine and p-xylylenediamine. Among them, aliphatic diamines are preferred, and hexamethylenediamine (1,6-diaminohexane) is particularly preferred. These diamines may be used individually or in combinations of two or more.

Examples of the polyamide-based resin (also to as nylon resin) include, but are not particularly limited to, nylon 6, nylon 66, nylon 11, nylon 12, nylon 6/10, nylon 6/12, semi-aromatic nylons including units of nylon 6T and/or nylon 6I, and copolymers of these nylon resins. In particular, nylon 6, nylon 66, and a copolymer of nylon 6 and nylon 66 are more preferred.

The polyamide-based resin can be produced by, e.g., a polyamide-based resin polymerization method that includes heating raw materials for the polyamide-based resin in the presence or absence of a catalyst. The method may or may not include a stirring process during the polymerization, but it is preferable that the raw materials are stirred to obtain a homogeneous product. The polymerization temperature may be set as appropriate in accordance with the degree of polymerization of the target polymer, the reaction yield, and the reaction time, and may be set to be lower in view of the quality of the polyamide-based resin to be obtained. The reaction rate may also be set as appropriate. The pressure is not particularly limited, and it is preferable that the polymerization system is placed under reduced pressure to efficiently extract volatile components out of the polymerization system.

The ends of the polyamide-based resin may be capped with an end-capping agent such as a carboxylic acid compound or an amine compound, if necessary. When a monocarboxylic acid or monoamine is used as an end-capping agent, the terminal amino group concentration or the terminal carboxyl group concentration of the resulting nylon resin is reduced compared to the case where such an end-capping agent is not used. On the other hand, when a dicarboxylic acid or diamine is used as an end-capping agent, the sum of the terminal amino group concentration and the terminal carboxyl group concentration is unchanged, but the ratio of the terminal amino group concentration to the terminal carboxyl group concentration is changed.

Specific examples of the carboxylic acid compound include, but are not particularly limited to, the following: aliphatic monocarboxylic acids such as acetic acid, propionic acid, butyric acid, valeric acid, caproic acid, enanthic acid, caprylic acid, pelargonic acid, undecanoic acid, lauric acid, tridecanoic acid, myristic acid, myristoleic acid, palmitic acid, stearic acid, oleic acid, linoleic acid, and arachic acid; alicyclic monocarboxylic acids such as cyclohexanecarboxylic acid and methylcyclohexanecarboxylic acid; aromatic monocarboxylic acids such as benzoic acid, toluic acid, ethylbenzoic acid, and phenylacetic acid; aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brassylic acid, tetradecanedioic acid, pentadecanedioic acid, and octadecanedioic acid; alicyclic dicarboxylic acids such as cyclohexanedicarboxylic acid; and aromatic dicarboxylic acids such as phthalic acid, isophthalic acid, terephthalic acid, and naphthalenedicarboxylic acid.

Specific examples of the amine compound include, but are not particularly limited to, the following: aliphatic monoamines such as butylamine, pentylamine, hexylamine, heptylamine, octylamine, 2-ethylhexylamine, nonylamine, decylamine, undecylamine, dodecylamine, tridecylamine, tetradecylamine, pentadecylamine, hexadecylamine, octadecylamine, nonadecylamine, and icosylamine; alicyclic monoamines such as cyclohexylamine and methylcyclohexylamine; aromatic monoamines such as benzylamine and β-phenylethylamine; aliphatic diamines such as 1,4-diaminobutane, 1,5-diaminopentane, 1,6-diaminohexane, 1,7-diaminoheptane, 1,8-diaminooctane, 1,9-diaminononane, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as xylylenediamine.

Although the terminal group concentration of the polyamide-based resin is not particularly limited, the terminal amino group concentration may be high so as to improve dyeability for the intended use of the fibers and design materials suitable for alloying for intended use of resin. Also, the terminal amino group concentration may be low so as to reduce coloration or gelation under long-term aging conditions. Moreover, both the terminal carboxyl group concentration and the terminal amino group concentration may be low so as to prevent the regeneration of lactam during remelting, filament breakage during melt spinning due to the formation of oligomers, mold deposit during continuous injection molding, and die mark formation during continuous film extrusion. The terminal group concentration may be adjusted according to the intended use, and both the terminal amino group concentration and the terminal carboxyl group concentration are preferably $1.0\times10^{-5}$ to $15.0\times10^{-5}$ eq/g, more preferably $2.0\times10^{-5}$ to $12.0\times10^{-5}$ eq/g, or particularly preferably $3.0\times10^{-5}$ to $11.0\times10^{-5}$ eq/g. In this specification, a numerical range indicated by " . . . to . . . " includes two end values in a manner similar to the numerical range indicated by " . . . or more and . . . or less".

There are some methods to add the end-capping agent. For example, the end-capping agent may be (i) added simultaneously with raw materials such as caprolactam in the initial stage of polymerization, (ii) added in the process of polymerization, or (iii) added while the molten nylon resin is passing through a vertical stirring-type thin film evaporator. The end-capping agent may be added as it is, or added after having been dissolved in a small amount of solvent.

The polyamide-based resin is preferably at least one selected from the group consisting of nylon 6 and nylon 66 from the viewpoint of physical properties, versatility, and costs of the resin. In an embodiment of the present invention, the wording "polyamide-based resin mainly containing at least one selected from the group consisting of nylon 6 and nylon 66" refers to the polyamide-based resin containing 80 mol % or more of nylon 6 and/or nylon 66.

The content of the sheath pigment in the sheath resin composition is, but is not particularly limited to, preferably 0.5 parts by weight or more and 20 parts by weight or less, more preferably 1 part by weight or more and 15 parts by weight or less, and even more preferably 3 parts by weight or more and 10 parts by weight or less, with respect to 100 parts by weight of the polyamide-based resin, for example. When the content of the sheath pigment is 0.5 parts by weight or more with respect to 100 parts by weight of the polyamide-based resin, coloring properties are further improved. When the content of the sheath pigment is 20 parts by weight or less with respect to 100 parts by weight of the polyamide-based resin, spinnability is further improved.

The sheath pigment is, but is not particularly limited to, preferably used in the form of masterbatch, for example. Specifically, it is possible to use a pigment masterbatch for the sheath obtained by adding the sheath pigment to a polyamide-based resin, and melt kneading and pelletizing the resulting mixture. The above-described polyamide-based resin can be used as a polyamide-based resin as appropriate, and a polyamide-based resin that is similar to the polyamide-based resin, which is the main component of the sheath, may also be used.

The polyamide-based resin composition that constitutes the sheath may contain other resins in addition to the polyamide-based resin. Examples of the other resins include a vinyl chloride-based resin, a modacrylic-based resin, a polycarbonate-based resin, a polyolefin-based resin, and a polyphenylene sulfide-based resin. Other resins may be used individually or in combinations of two or more.

In one or more embodiments of the present invention, the core is composed of a polyester-based resin composition (also referred to as "core resin composition" in the following) containing a polyester-based resin as a main component. In one or more embodiments of the present invention, the term "the polyester-based resin composition containing a polyester-based resin as a main component" indicates that the polyester-based resin composition contains the polyester-based resin in an amount of more than 55% by weight with respect to 100% by weight of the total weight of the polyester-based resin composition, and the content of the polyester-based resin is preferably 60% by weight or more, more preferably 67% by weight or more, even more preferably 75% by weight or more, further preferably 85% by weight or more, still more preferably 90% by weight or more, and yet more preferably 95% by weight or more.

The polyester-based resin is at least one selected from the group consisting of polyalkylene terephthalate and a copolyester mainly containing polyalkylene terephthalate from the viewpoint of physical properties, versatility, and costs. In one or more embodiments of the present invention, the wording "copolyester mainly containing the polyalkylene terephthalate" refers to the copolyester containing 80 mol % or more of polyalkylene terephthalate.

Examples of the polyalkylene terephthalate include, but are not particularly limited to, polyethylene terephthalate, polypropylene terephthalate, polybutylene terephthalate, and polycyclohexane dimethylene terephthalate.

Examples of the copolyester mainly containing the polyalkylene terephthalate include, but are not particularly limited to, copolyesters mainly containing polyalkylene terephthalate such as polyethylene terephthalate, polypropylene terephthalate, polybutylene terephthalate, or polycyclohexane dimethylene terephthalate and other copolymerizable components.

Examples of the other copolymerizable components include: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids and their derivatives containing sulfonates such as 5-sodiumsulfoisophthalic acid and dihydroxyethyl 5-sodiumsulfoisophthalate; 1,2-propanediol; 1,3-propanediol; 1,4-butanediol; 1,6-hexanediol; neopentyl glycol; 1,4-cyclohexanedimethanol; diethylene glycol; polyethylene glycol; trimethylolpropane; pentaerythritol; 4-hydroxybenzoic acid; ε-caprolactone; and an ethylene glycol ether of bisphenol A.

The copolyester is preferably produced by adding a small amount of other copolymerizable components to polyalkylene terephthalate serving as a main component, and allowing them to react with each other, from the viewpoint of stability and ease of operation. Examples of the polyalkylene terephthalate include a polymer of terephthalic acid and/or its derivatives (e.g., methyl terephthalate) and alkylene glycol. The copolyester may be produced by adding a small amount of monomer or oligomer component serving as other copolymerizable components, to a mixture of terephthalic acid and/or its derivatives (e.g., methyl terephthalate) and alkylene glycol, used for polymerization of polyalkylene terephthalate serving as a main component, and subjecting them to polymerization.

It is sufficient that the copolyester has a structure in which the other copolymerizable components are polycondensed on the main chain and/or side chain of polyalkylene terephthalate serving as a main component, and the copolymerization method and the like are not particularly limited.

Specific examples of the copolyester mainly containing polyalkylene terephthalate include a polyester obtained through copolymerization of polyethylene terephthalate serving as a main component with one compound selected from the group consisting of an ethylene glycol ether of bisphenol A, 1,4-cyclohexanedimethanol, isophthalic acid, and dihydroxyethyl 5-sodiumsulfoisophthalate.

The polyalkylene terephthalate and the copolyester mainly containing polyalkylene terephthalate may be used individually or in a combination of two or more. In particular, polyethylene terephthalate; polypropylene terephthalate; polybutylene terephthalate; a polyester obtained through copolymerization of polyethylene terephthalate serving as a main component with an ethylene glycol ether of bisphenol A; a polyester obtained through copolymerization of polyethylene terephthalate serving as a main component with 1,4-cyclohexanedimethanol; a polyester obtained through copolymerization of polyethylene terephthalate serving as a main component with isophthalic acid; a polyester obtained through copolymerization of polyethylene terephthalate serving as a main component with dihydroxyethyl 5-sodiumsulfoisophthalate, and the like are preferably used individually or in a combination of two or more.

The intrinsic viscosity (also referred to as an "IV value") of the polyester-based resin is not particularly limited, and is preferably 0.3 dL/g or more and 1.2 dL/g or less, and more preferably 0.4 dL/g or more and 1.0 dL/g or less. When the intrinsic viscosity is 0.3 dL/g or more, it is possible to prevent a decrease in the mechanical strength of the resulting fibers, and also to eliminate the risk of dripping during a flammability test. When the intrinsic viscosity is 1.2 dL/g or less, the molecular weight does not become too large and the melt viscosity does not become too high, thereby facilitating melt spinning and making the fineness of the fibers more likely to be uniform.

The content of the core pigment in the core resin composition is, but is not particularly limited to, preferably 0.5 parts by weight or more and 20 parts by weight or less, more preferably 1 part by weight or more and 15 parts by weight or less, and even more preferably 3 parts by weight or more and 10 parts by weight or less, with respect to 100 parts by weight of the polyester-based resin, for example. When the content of the core pigment is 0.5 parts by weight or more with respect to 100 parts by weight of the polyester-based resin, coloring properties are further improved. When the content of the core pigment is 20 parts by weight or less with respect to 100 parts by weight of the polyester-based resin, spinnability is further improved.

The core pigment is, but is not particularly limited to, preferably used in the form of masterbatch, for example. Specifically, it is possible to use a pigment masterbatch for the core obtained by adding the core pigment to a polyester-based resin, and melt kneading and pelletizing the resulting mixture. The above-described polyester-based resin can be used as a polyester-based resin as appropriate, and a polyester-based resin that is similar to the polyester-based resin, which is the main component of the core, may be used.

The polyester-based resin composition that constitutes the core may contain other resins in addition to the polyester-based resin, which is a main component resin. Examples of the other resins include a polyamide-based resin, a vinyl chloride-based resin, a modacrylic-based resin, a polycarbonate-based resin, a polyolefin-based resin, and a polyphenylene sulfide-based resin. Other resins may be used individually or in combinations of two or more.

From the viewpoint of obtaining a texture and an appearance similar to those of human hair and improving the curling properties and curl-holding properties, the core of the core-sheath conjugate fiber for artificial hair is preferably composed of a polyester-based resin composition containing, as a main component, at least one polyester-based resin selected from the group consisting of polyalkylene terephthalate and a copolyester mainly containing polyalkylene terephthalate, and the sheath thereof is more preferably composed of a polyamide-based resin composition containing, as a main component, a polyamide-based resin mainly containing at least one selected from the group consisting of nylon 6 and nylon 66.

In one or more embodiments of the present invention, a flame retardant may be used in combination from the viewpoint of flame resistance. Examples of the flame retardant include bromine-containing flame retardants and phosphorus-containing flame retardants. Examples of the phosphorus-containing flame retardant include phosphoric acid ester amide compounds and organic cyclic phosphorus-based compounds. Examples of the bromine-based flame retardant include, but are not particularly limited to, the following: a brominated epoxy-based flame retardant; bromine-containing phosphate esters such as pentabromotoluene, hexabromobenzene, decabromodiphenyl, decabromodiphenyl ether, bis(tribromophenoxy)ethane, tetrabromophthalic anhydride, ethylene bis(tetrabromophthalimide), ethylene bis(pentabromophenyl), octabromotrimethylphenylindan, and tris(tribromoneopentyl)phosphate; brominated polystyrenes; brominated polybenzyl acrylates; brominated phenoxy resins; brominated polycarbonate oligomers; tetrabromobisphenol A and tetrabromobisphenol A derivatives such as tetrabromobisphenol A-bis(2,3-dibromopropyl ether), tetrabromobisphenol A-bis(allyl ether), and tetrabromobisphenol A-bis(hydroxyethyl ether); bromine-containing triazine compounds such as tris(tribromophenoxy)triazine; and bromine-containing isocyanuric acid compounds such as tris(2,3-dibromopropyl)isocyanurate. In particular, the brominated epoxy-based flame retardant is preferred in terms of heat resistance and flame resistance.

The brominated epoxy-based flame retardant may have an epoxy group or tribromophenol at the end of the molecule as a raw material. The structure of the brominated epoxy-based flame retardant after melt kneading is not particularly limited, and preferably has 80 mol % or more of a constitutional unit represented by the following chemical formula (8), where the total number of the constitutional unit represented by the chemical formula (8) and other constitutional units in which at least a part of the chemical formula (8) has been modified is taken as 100 mol %. The structure at the end of the molecule of the brominated epoxy-based flame retardant may be changed after melt kneading. For example, the end of the molecule of the brominated epoxy-based flame retardant may be replaced by groups other than the epoxy group or tribromophenol, such as a hydroxyl group, a phosphoric acid group, and a phosphonic acid group. Alternatively, the end of the molecule of the brominated epoxy-based flame retardant may be bound to a polyester component through an ester group.

[Chemical formula 8] (8)

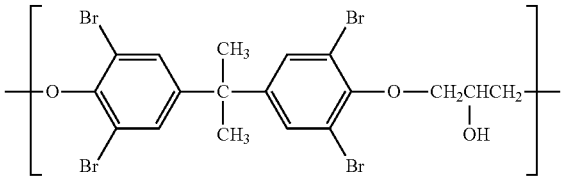

A part of the structure of the brominated epoxy-based flame retardant, except for the end of the molecule, may also be changed. For example, the secondary hydroxyl group and the epoxy group of the brominated epoxy-based flame retardant may be bound together to form a branched structure. Moreover, a part of the bromine of the chemical formula (8) may be eliminated or added if the bromine content in the molecule of the brominated epoxy-based flame retardant is not significantly changed.

The brominated epoxy-based flame retardant may be, e.g., a polymeric brominated epoxy-based flame retardant as represented by the following chemical formula (9). In the chemical formula (9), m is 1 to 1000. The polymeric brominated epoxy-based flame retardant represented by the chemical formula (9) may be a commercially available product such as a brominated epoxy-based flame retardant (trade name "SR-T2MP") manufactured by Sakamoto Yakuhin Kogyo Co., Ltd.

[Chemical formula 9] (9)

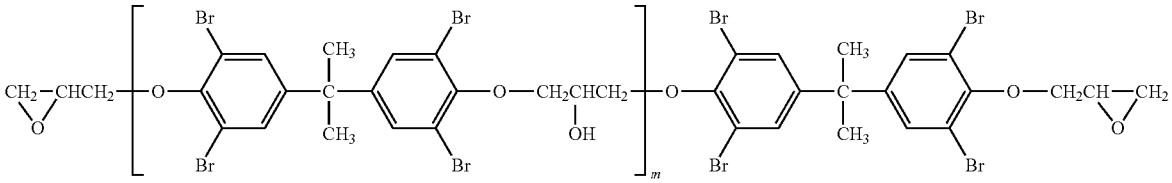

The content of the brominated epoxy-based flame retardant in the core and/or the sheath is, but is not particularly limited to, 5 parts by weight or more and 40 parts by weight or less with respect to 100 parts by weight of the main component resin, for example. From the viewpoint of heat resistance and flame resistance, for example, it is preferable that the core is composed of a polyester-based resin composition containing at least one polyester-based resin selected from the group consisting of polyalkylene terephthalate and a copolyester mainly containing polyalkylene terephthalate in an amount of 100 parts by weight, a brominated epoxy-based flame retardant in an amount of 5 parts by weight or more and 40 parts by weight or less, and a core pigment in an amount of 0.5 parts by mass or more and 20 parts by mass or less, and the sheath is composed of a polyamide-based resin composition containing a polyamide-based resin mainly containing at least one selected from the group consisting of nylon 6 and nylon 66 in an amount of 100 parts by weight, a brominated epoxy-based flame retardant in an amount of 5 parts by weight or more and 40 parts by weight or less, and a sheath pigment in an amount of 0.5 parts by mass or more and 20 parts by mass or less.

In one or more embodiments of the present invention, a flame retardant auxiliary may be used in combination. The flame retardant auxiliary is not particularly limited, and from the viewpoint of flame resistance, it is preferable to use an antimony-based compound or a composite metal containing antimony. Examples of the antimony-based compound include antimony trioxide, antimony tetroxide, antimony pentoxide, sodium antimonate, potassium antimonate, and calcium antimonate. In terms of the effects of the flame retardant auxiliary on the flame resistance and the texture, it is more preferable that the flame retardant auxiliary is at least one selected from the group consisting of antimony trioxide, antimony pentoxide, and sodium antimonate.

The content of the flame retardant auxiliary in the core and/or the sheath is preferably, but is not particularly limited to, 0.1 parts by weight or more and 10 parts by weight or less with respect to 100 parts by weight of the main component resin, for example.

The core-sheath conjugate fibers for artificial hair may contain various additives as needed, to the extent that they do not interfere with the purpose of one or more embodiments of the present invention. The additives include, e.g., a heat-resistant agent, a stabilizer, a fluorescent agent, an antioxidant, and an antistatic agent.

Production Method

The core-sheath conjugate fibers for artificial hair according to one or more embodiments of the present invention can be produced by separately melt kneading the resin composition for constituting the core and the resin composition for constituting the sheath using any of various ordinary kneading machines, and melt spinning the resulting compositions using a core-sheath conjugate nozzle.

A core component for constituting the core is prepared by melt kneading, using any of various ordinary kneading machines, a polyester-based resin composition obtained by dry-blending the above-described components such as the polyester-based resin, the core pigment (pigment masterbatch for a core may be used), and the brominated epoxy-based flame retardant, whereas a sheath component is prepared by melt kneading, using any of various ordinary kneading machines, a polyamide-based resin composition obtained by dry-blending the above-described components such as the polyamide-based resin, the sheath pigment (pigment masterbatch for the sheath may be used), and the brominated epoxy-based flame retardant, and then the core-sheath conjugate fibers for artificial hair can be produced by melt spinning the core component and the sheath component using a core-sheath conjugate spinning nozzle, for example.

A pigment masterbatch for the core is obtained by dry-blending the above-described polyester-based resin and the core pigment, melt kneading the resulting mixture using any of various ordinary kneading machines, and pelletizing the resulting mixture, for example.

A pigment masterbatch for the sheath is obtained by dry-blending the above-described polyamide-based resin and the sheath pigment, melt kneading the resulting mixture using any of various ordinary kneading machines, and pelletizing the resulting mixture, for example.

Examples of the kneading machine include a single-screw extruder, a twin-screw extruder, a roll, a Banbury mixer, and a kneader. In particular, the twin-screw extruder is preferred in terms of the adjustment of the degree of kneading and ease of operation.

In the melt spinning method, in the case of a polyester-based resin composition, for example, melt spinning is performed while the temperatures of an extruder, a gear pump, a nozzle, and the like are set to 250° C. or more and 300° C. or less, and in the case of a polyamide-based resin composition, melt spinning is performed while the temperatures of an extrudes a gear pump, a nozzle, and the like are set to 260° C. or more and 320° C. or less, after which the extruded yarns are passed through a heating cylinder and cooled to a temperature of not more than the glass transition point of the corresponding resin, and wound up at a speed of 30 m/min or more and 5000 m/min or less, and thus melt spun yarns (undrawn yarns) are obtained.

Specifically, during the melt spinning, the polyester-based resin composition for constituting the core is supplied from a core extruder of a melt spinning machine, the polyamide-based resin composition for constituting the sheath is supplied from a sheath extruder of the melt spinning machine, and the molten polymer is extruded through a core-sheath type conjugate spinning nozzle (holes) with a predetermined shape, and thus the melt spun yarns (undrawn yarns) are obtained.

It is preferable that the melt spun yarns (undrawn yarns) are hot drawn. The drawing may be performed by either a two-step method or a direct spinning-drawing method. In the two-step method, the melt spun yarns are once wound, and then drawn. In the direct spinning-drawing method, the melt spun yarns are drawn continuously without winding. The hot drawing may be performed by a single-stage drawing method or a multi-stage drawing method that includes two or more stages. The heating means in the hot drawing may be, e.g., a heating roller, a heat plate, a steam jet apparatus, or a hot water bath, and they can be used in combination as appropriate.

In one or more embodiments of the present invention, oils such as a fiber treatment agent and a softening agent may be applied to the core-sheath conjugate fibers for artificial hair to make the texture and feel of the fibers more similar to human hair.

The fiber treatment agent may be, e.g., a silicone-based fiber treatment agent or a non-silicone-based fiber treatment agent used to improve the texture and combing property of the fibers.

The core-sheath conjugate fibers for artificial hair may be subjected to gear crimping. The gear crimping imparts gentle curves and natural appearance to the fibers, and also reduces the adhesion between the fibers, thereby also improving the combing property.

In the gear crimping, the fibers are generally heated to a temperature higher than the softening temperature and allowed to pass through two engaged gears so that the shape of the gears is transferred to the fibers. This can create curls on the fibers. Also, in the fiber producing stage, if necessary, curls having different shapes can be created by heating the core-sheath conjugate fibers for artificial hair at different temperatures.

Hair Ornaments

In one or more embodiments of the present invention, the core-sheath conjugate fibers for artificial hair can be suitably used for hair ornaments. The hair ornament is, but is not particularly limited to, preferably any one selected from the group consisting of a hair wig, a hairpiece, weaving hair, a hair extension, braided hair, a hair accessory, and doll hair, and a hair wig and weaving hair are more preferable from the viewpoint of more effectively exhibiting sufficiently good curl setting properties.

In one or more embodiments of the present invention, the core-sheath conjugate fibers for artificial hair can be used as artificial hair either individually or can be used in combination with other artificial hair fibers and natural fibers such as human hair and animal hair. The hair ornament may be constituted only by the core-sheath conjugate fibers for artificial hair according one or more embodiments of the present invention, or may be constituted by combining the core-sheath conjugate fibers with other artificial hair fibers or natural fibers such as human hair and animal hair. Examples of the other artificial hair fibers include acrylic fibers.

EXAMPLES

Hereinafter, one or more embodiments of the present invention will be described in more detail by way of examples. However, one or more embodiments of the present invention are not limited to the following examples.

The measurement methods and the evaluation methods used in Examples and Comparative Examples are as follows.

Single Fiber Fineness

Using an auto-vibronic fineness measuring device "DENIER COMPUTER DC-11" (manufactured by Search Co., Ltd.), 30 samples were measured to determine their respective single fiber fineness, and the average of the measured values of the samples was calculated and taken as the single fiber fineness of the core-sheath conjugate fibers.

Core-to-Sheath Area Ratio

At room temperature, fibers were bundled, fixed with a shrinkable tube such that the fiber bundle (total fineness was 550 dtex) was not displaced, cut into circular slices using a cutter to prepare fiber bundles for cross-section observation. An image of this fiber bundle was captured using a laser microscope ("VK-9500" manufactured by Keyence Corporation) at a magnification of 500 times, and a core-to-sheath area ratio was calculated based on a photograph of the obtained fiber cross-section.

Texture

Sensory evaluation was performed by a professional cosmetologist, and the texture was evaluated in the following three stages.

A: The texture is very good and equivalent to that of human hair.

B: The texture is good, but slightly inferior to that of human hair.

Coloring Properties

<Measurement of L*a*b* Values of Fiber Bundles>

At room temperature, fibers were bundled and fixed with a shrinkable tube such that the fiber bundle (total fineness was 700000 dtex) was not displaced, to prepare fiber bundles for color tone measurement. The color tone of the fiber bundle for color tone measurement was measured using a color tone measuring device ("MAMBO" manufactured by Bossa Nova Technologies) to acquire the L*a*b* value.

<Measurement of L*a*b* Values of Pigment Masterbatch>

The pigment masterbatch for a sheath was pressed using a transfer molding machine to prepare a 5 cm×5 cm flat plate (with a thickness of 3 mm), a color tone was measured in the reflectance measuring mode of VSS-400 (manufactured by Nippon Denshoku Industries Co., Ltd.) to acquire the L*a*b* value. The masterbatch of the pigment 2 was used in Comparative Examples 1 and 2.

<Evaluation>

Coloring properties were evaluated in the following four stages by comparing the L*a*b* values of the fiber bundles obtained above with the L*a*b* values of the pigment masterbatch. A indicates that coloring properties are favorable, and B to D indicate that coloring properties are poor.

A: When two measured values are compared, the difference between L* values, the difference between a* values, and the difference between b* values are each 10 or less.

B: When two measured values are compared, two of the difference between L* values, the difference between a* values, and the difference between b* values are each 10 or less.

C: When two measured values are compared, one of the difference between L* values, the difference between a* values, and the difference between b* values is 10 or less.

D: When two measured values are compared, the difference between L* values, the difference between a* values, and the difference between b* values are each more than 10.

Spinnability

Favorable: Yarn breakage does not occur during spinning for 5 minutes.

Poor: Yarn breakage occurs once or more during spinning for 5 minutes. Alternatively, spinning is not possible.

The pigments below were used in examples and comparative examples.

Pigment 1: Pigment Yellow 147

Pigment 2: Pigment Yellow 150

Pigment 3: Acid orange 74

Pigment 4: Bis[3-hydroxy-4-[(2-hydroxy-3,5-dinitrophenyl)azo]-N-phenyl-2-naphthalenecarboxamide (2-)]hydrogen chromate Pigment 5: Hansa Yellow Pigment 6: Pigment Yellow 62

Production Example 1

100 parts by weight of polyethylene terephthalate pellets (EastPET trade name "A-12" manufactured by East West Chemical Private Limited) were mixed with 10 parts by weight of the pigment 1. The mixture was dry blended and then fed into a twin-screw extruder, where it was melt-kneaded at a barrel temperature of 280° C. and pelletized. Thus, the masterbatch of the pigment 1 was obtained.

Production Example 2

100 parts by weight of nylon 6 (trade name "A1030BRL" manufactured by Unitika Ltd.) were mixed with 10 parts by weight of the pigment 2. The mixture was dry blended and then fed into a twin-screw extruder, where it was melt-kneaded at a barrel temperature of 260° C. and pelletized. Thus, the masterbatch of the pigment 2 was obtained.

Production Example 3

The masterbatch of the pigment 3 was produced in the same manner as Production Example 2 except that the pigment 3 was used instead of the pigment 2.

Production Example 4

The masterbatch of the pigment 4 was produced in the same manner as Production Example 2 except that the pigment 4 was used instead of the pigment 2.

Production Example 5

The masterbatch of the pigment 5 was produced in the same manner as Production Example 2 except that the pigment 5 was used instead of the pigment 2.

Production Example 6

The masterbatch of the pigment 6 was produced in the same manner as Production Example 2 except that the pigment 6 was used instead of the pigment 2.

Example 1

First, 100 parts by weight of polyethylene terephthalate pellets (also referred to as "PET" in the following) (EastPET trade name "A-12" manufactured by East West Chemical Private Limited) were mixed with 30 parts by weigh of a brominated epoxy-based flame retardant (trade name "SR-T2MP" manufactured by Sakamoto Yakuhin Kogyo Co., Ltd.), 3 parts by weight of sodium antimonate (trade name "SA-A" manufactured by Nihon Seiko Co., Ltd.), and 5 parts by weight of the masterbatch of the pigment 1. The mixture was dry blended and then fed into a twin-screw extruder, where it was melt-kneaded at a barrel temperature of 280° C. and pelletized. Thus, a polyester-based resin composition was obtained.

Then, 100 parts by weight of nylon 6 (also referred to as "PA6" in the following) (trade name "A1030BRL" manufactured by Unitika Ltd.) were mixed with 12 parts by weight of a brominated epoxy-based flame retardant (trade name "SR-T2MP manufactured by Sakamoto Yakuhin Kogyo Co., Ltd.), 2 parts by weight of sodium antimonate (trade name "SA-A" manufactured by Nihon Seiko Co., Ltd.), and 5 parts by weight of the masterbatch of the pigment 3. The mixture was dry blended and then fed into a twin-screw extruder, where it was melt-kneaded at a barrel temperature of 260° C. and pelletized. Thus, a polyamide-based resin composition was obtained.

Next, the polyester-based resin composition in the form of pellets and the polyamide-based resin composition in the form of pellets were fed into extruders, respectively, and then extruded through a core-sheath type conjugate spinning nozzle (the fiber cross-section and the core cross-section of the nozzle had a flat bilobed shape) at a nozzle temperature of 270° C. and wound up at a speed of 40 to 200 m/min. This resulted in undrawn yarns of core-sheath conjugate fibers containing the polyester-based resin composition as a core and the polyamide-based resin composition as a sheath and having a core-to-sheath area ratio of 5:5.

The undrawn yarns thus obtained were drawn to 3 times and taken up at a speed of 45 m/min by using a heating roller at 85° C. Subsequently, the drawn yarns were further heat-treated and wound up at a speed of 45 m/min by using a heating roller at 205° C. A polyether oil (trade name "KWC-Q" manufactured by Marubishi Oil Chemical Corporation) was applied to the drawn yarns so that the amount of oil applied was 0.20% omf (i.e., the weight percentage of the oil (pure content) with respect to the dry fiber weight). Then, the resulting yarns were dried, and thus core-sheath conjugate fibers were obtained.

Example 2

Core-sheath conjugate fibers were produced in the same manner as Example 1 except that a polyamide-based resin composition was produced using the masterbatch of the pigment 4 instead of the masterbatch of the pigment 3.

Example 3

Core-sheath conjugate fibers were produced in the same manner as Example 1 except that a polyamide-based resin composition was produced using the masterbatch of the pigment 2 instead of the masterbatch of the pigment 3.

Example 4

Core-sheath conjugate fibers were produced in the same manner as Example 1 except that a polyamide-based resin composition was produced using the masterbatch of the pigment 5 instead of the masterbatch of the pigment 3.

Comparative Example 1

100 parts by weight of polyethylene terephthalate pellets (also referred to as "PET" in the following) (EastPET trade name "A-12" manufactured by East West Chemical Private Limited) were mixed with 30 parts by weight of a brominated epoxy-based flame retardant (trade name "SR-T2MP" manufactured by Sakamoto Yakuhin Kogyo Co., Ltd.), 3 parts by weight of sodium antimonate (trade name "SA-A" manufactured by Nihon Seiko Co., Ltd.), and 5 parts by weight of the masterbatch of the pigment 2. The mixture was thy blended and then fed into a twin-screw extruder, where it was melt-kneaded at a barrel temperature of 280° C. and pelletized. Thus, a polyester-based resin composition was obtained. The obtained polyester-based resin composition was extruded through a spinning nozzle having a nozzle diameter of 2 mm and having nozzle pores with circular cross-sections at a nozzle temperature of 270° C. and wound up at a speed of 40 to 200 m/min. This resulted in undrawn yarns.

The undrawn yarns thus obtained were drawn to 3 times and taken up at a speed of 45 m/min by using a heating roller at 85° C. Subsequently, the drawn yarns were further heat-treated and wound up at a speed of 45 m/min by using a heating roller heated at 205° C. A polyether oil (trade name "KWC-Q" manufactured by Marubishi Oil Chemical Corporation) was applied to the drawn yarns so that the amount of oil applied was 0.20% omf (the weight percentage of the oil (pure content) with respect to the dry fiber weight), and the resulting yarns were dried to obtain PET fibers.

Comparative Example 2

The obtained polyamide-based resin composition produced in the same manner as Example 3 was extruded through a spinning nozzle having a nozzle diameter of 2 mm and having nozzle pores with circular cross-sections at a nozzle temperature of 270° C. and wound up at a speed of 40 to 200 m/min. However, spinnability was poor, and thus fibers were not able to be obtained.

Comparative Example 3

Core-sheath conjugate fibers were produced in the same manner as Example 1 except that a polyester-based resin composition was produced using the masterbatch of the pigment 2 instead of the masterbatch of the pigment 1, and a polyamide-based resin composition was produced using the masterbatch of the pigment 2 instead of the masterbatch of the pigment 3.

Comparative Example 4

Core-sheath conjugate fibers were produced in the same manner as Example 1 except that a polyamide-based resin composition was produced using the masterbatch of the pigment 1 instead of the masterbatch of the pigment 3.

Comparative Example 5

Core-sheath conjugate fibers were produced in the same manner as Example 1 except that a polyamide-based resin composition was produced using the masterbatch of the pigment 6 instead of the masterbatch of the pigment 3.

In the examples and comparative examples, the texture, coloring properties, and spinnability were measured and evaluated as described above. Table 1 shows the results.

TABLE 1

| | Fiber Structure | Core Pigment | Sheath Pigment | Spinnability | Texture | Coloring properties |
|---|---|---|---|---|---|---|
| Ex. 1 | conjugate fiber | Pigment 1 | Pigment 3 | favorable | A | A |
| Ex. 2 | conjugate fiber | Pigment 1 | Pigment 4 | favorable | A | A |
| Ex. 3 | conjugate fiber | Pigment 1 | Pigment 2 | favorable | A | A |
| Ex. 4 | conjugate fiber | Pigment 1 | Pigment 5 | favorable | A | A |
| Comp. Ex. 1 | mono-component fiber | Pigment 2 | | favorable | B | C |
| Comp. Ex. 2 | mono-component fiber | Pigment 2 | | poor | — | — |
| Comp. Ex. 3 | conjugate fiber | Pigment 2 | Pigment 2 | favorable | A | B |
| Comp. Ex. 4 | conjugate fiber | Pigment 1 | Pigment 1 | favorable | A | D |
| Comp. Ex. 5 | conjugate fiber | Pigment 1 | Pigment 6 | favorable | B | D |

Figure 2:
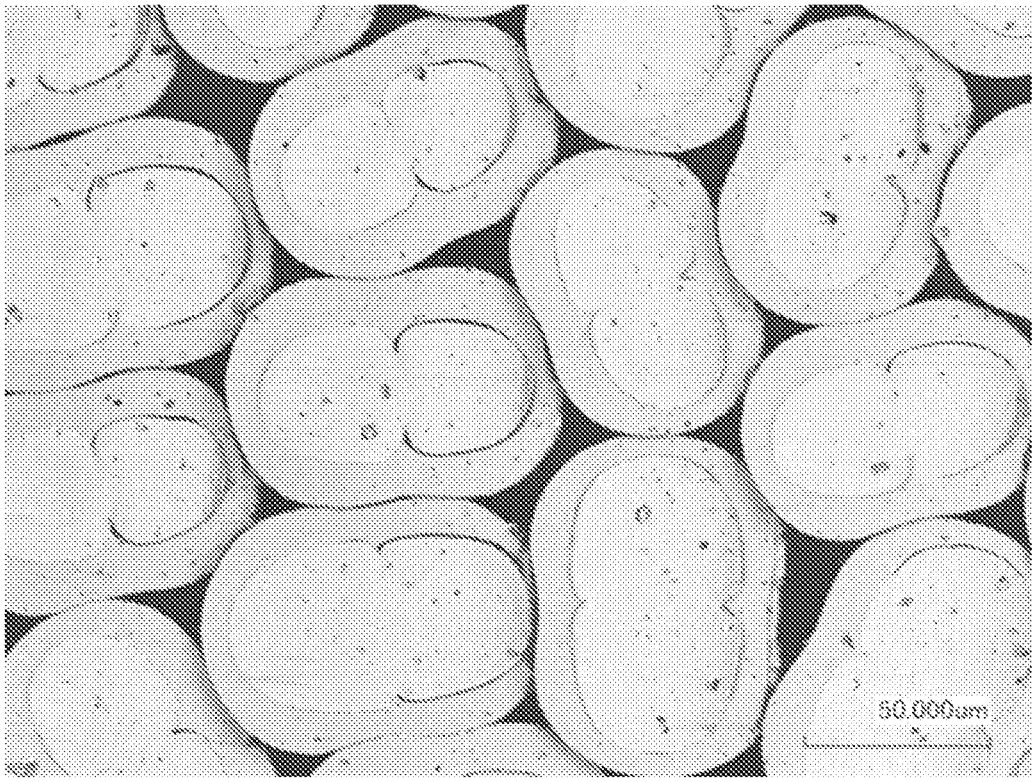
FIG. 2 is a laser microscopic photograph of fiber cross-sections of core-sheath conjugate fibers for artificial hair of Example 1.

FIG. 2 is a laser microscopic photograph (1000 times) of cross-sections of the fibers of Example 1. As illustrated in FIG. 2, in the core-sheath conjugate fibers for artificial hair, the fiber cross-sections and the cores all had a flat bilobed cross-sectional shape.

As can be seen from Table 1 above, the fibers of Examples 1 to 4 had a texture that is similar to that of human hair, and also had favorable coloring properties and spinnability.

On the other hand, the fibers of Comparative Example 1 obtained using the polyester-based resin composition containing the nickel complex pigment (a) had poor coloring properties. As described above, fibers were not produced in Comparative Example 2. In the cores, the fibers of Comparative Examples 3 and 4 obtained using the same pigments as in the sheaths had poor coloring properties. In the sheath, the fibers of Comparative Example 5 in which none of the nickel complex pigment (a), the chromium complex pigment (b), and the nitro group-containing organic pigment (c) were contained also had poor coloring properties.

One or more embodiments of the present invention preferably include at least the following embodiments, but are not limited thereto.

[1] A core-sheath conjugate fiber for artificial hair comprising:

a core; and a sheath, wherein the core is composed of a polyester-based resin composition containing a polyester-based resin as a main component, and the sheath is composed of a polyamide-based resin composition containing a polyamide-based resin as a main component, the sheath contains at least one organic pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that contains no metal and contains a nitro group, and the core contains a pigment that is different from the pigment of the sheath.

[2] The core-sheath conjugate fiber for artificial hair according to [1], wherein the core is composed of a polyester-based resin composition containing at least one polyester-based resin selected from the group consisting of polyalkylene terephthalate and a copolyester mainly containing polyalkylene terephthalate.

[3] The core-sheath conjugate fiber for artificial hair according to [1] or [2], wherein the sheath is composed of a polyamide-based resin composition containing a polyamide-based resin mainly containing at least one selected from the group consisting of nylon 6 and nylon 66.

[4] The core-sheath conjugate fiber for artificial hair according to any one of [1] to [3], wherein the organic pigment contained in the sheath is at least one selected from the group consisting of an azo-based pigment and an azomethine-based pigment.

[5] The core-sheath conjugate fiber for artificial hair according to any one of [1] to [4], wherein the core contains an anthraquinone-based pigment.

[6] The core-sheath conjugate fiber for artificial hair according to any one of [1] to [5], wherein the core-sheath conjugate fiber for artificial hair has a flat bilobed cross-sectional shape.

[7] The core-sheath conjugate fiber for artificial hair according to any one of [1] to [6], wherein the core has a flat bilobed cross-sectional shape.

[8] A hair ornament comprising the core-sheath conjugate fiber for artificial hair according to any one of [1] to [7].

[9] The hair ornament according to [8], wherein the hair ornament is any one selected from the group consisting of a hair wig, a hairpiece, weaving hair, a hair extension, braided hair, a hair accessory, and doll hair.

[10] A method for producing the core-sheath conjugate fiber for artificial hair according to any one of [1] to [7], comprising:

producing a pigment masterbatch for a sheath by mixing, into a polyamide-based resin, at least one sheath pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that contains no metal and contains a nitro group;

producing a pigment masterbatch for a core by mixing a pigment that is different from the sheath pigment into a polyester-based resin; and melt spinning a core resin composition and a sheath resin composition using a core-sheath conjugate nozzle.

DESCRIPTION OF REFERENCE NUMERALS

1 Core-sheath conjugate fiber for artificial hair (cross-section)
10 Sheath
20 Core

The invention claimed is:

1. A core-sheath conjugate fiber for artificial hair comprising:

a core; and a sheath, wherein the core comprises a polyester-based resin composition comprising a polyester-based resin, and the sheath comprises a polyamide-based resin composition comprising a polyamide-based resin, the sheath comprises at least one organic pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that comprises no metal and comprises a nitro group, and the core comprises a pigment that is different from the organic pigment of the sheath.

2. The core-sheath conjugate fiber for artificial hair according to claim 1, wherein the core comprises a polyester-based resin composition comprising at least one polyester-based resin selected from the group consisting of polyalkylene terephthalate and a copolyester comprising 80 mol % or more of polyalkylene terephthalate.

3. The core-sheath conjugate fiber for artificial hair according to claim 1, wherein the sheath comprises a polyamide-based resin composition comprising a polyamide-based resin comprising 80 mol % or more of at least one selected from the group consisting of nylon 6 and nylon 66.

4. The core-sheath conjugate fiber for artificial hair according to claim 1, wherein the organic pigment contained in the sheath is at least one selected from the group consisting of an azo-based pigment and an azomethine-based pigment.

5. The core-sheath conjugate fiber for artificial hair according to claim 1, wherein the core comprises an anthraquinone-based pigment.

6. The core-sheath conjugate fiber for artificial hair according to claim 1, wherein the core-sheath conjugate fiber for artificial hair has a flat bilobed cross-sectional shape.

7. The core-sheath conjugate fiber for artificial hair according to claim 1, wherein the core has a flat bilobed cross-sectional shape.

8. A hair ornament comprising the core-sheath conjugate fiber for artificial hair according to claim 1.

9. The hair ornament according to claim 8, wherein the hair ornament is at least one selected from the group consisting of a hair wig, a hairpiece, weaving hair, a hair extension, braided hair, a hair accessory, and doll hair.

10. The hair ornament according to claim 8, wherein the core of the core-sheath conjugate fiber for artificial hair comprises a polyester-based resin composition comprising at least one polyester-based resin selected from the group consisting of polyalkylene terephthalate and a copolyester comprising 80 mol % or more of polyalkylene terephthalate.

11. The hair ornament according to claim 8, wherein the sheath of the core-sheath conjugate fiber for artificial hair comprises a polyamide-based resin composition comprising a polyamide-based resin comprising 80 mol % or more of at least one selected from the group consisting of nylon 6 and nylon 66.

12. The hair ornament according to claim 8, wherein the organic pigment contained in the sheath of the core-sheath conjugate fiber for artificial hair is at least one selected from the group consisting of an azo-based pigment and an azomethine-based pigment.

13. The hair ornament according to claim 8, wherein the core of the core-sheath conjugate fiber for artificial hair comprises an anthraquinone-based pigment.

14. The hair ornament according to claim 8, wherein the core-sheath conjugate fiber for artificial hair has a flat bilobed cross-sectional shape.

15. The hair ornament according to claim 8, wherein the core of the core-sheath conjugate fiber for artificial hair has a flat bilobed cross-sectional shape.

16. A method for producing the core-sheath conjugate fiber for artificial hair according to claim 1, comprising:

producing a pigment masterbatch for a sheath by mixing, into a polyamide-based resin, at least one sheath pigment selected from the group consisting of (a) a nickel complex pigment in which nickel and an organic dye structure are in a coordinate bond at a ratio of 1:1 or 1:2, (b) a chromium complex pigment in which chromium and an organic dye structure are in a coordinate bond at a ratio of 1:1 or 1:2, and (c) an organic pigment that comprises no metal and comprises a nitro group;

producing a pigment masterbatch for a core by mixing a pigment that is different from the sheath pigment into a polyester-based resin; and melt spinning a core resin composition and a sheath resin composition using a core-sheath conjugate nozzle.

* * * * *